US007198348B2

(12) United States Patent
Hu

(10) Patent No.: US 7,198,348 B2
(45) Date of Patent: Apr. 3, 2007

(54) INKJET PRINTER IDENTIFICATION CIRCUIT

(75) Inventor: Hung-Lieh Hu, Hsinchu (TW)

(73) Assignee: International United Technology Co., Ltd., Hsinchu (TW)

( * ) Notice: Subject to any disclaimer, the term of this patent is extended or adjusted under 35 U.S.C. 154(b) by 281 days.

(21) Appl. No.: 10/709,430

(22) Filed: May 5, 2004

(65) Prior Publication Data

US 2005/0168511 A1 Aug. 4, 2005

(30) Foreign Application Priority Data

Jan. 29, 2004 (TW) ..... 93101929 A

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS

| | | | | |
|---|---|---|---|---|
| 4,827,257 | A * | 5/1989 | Kortegaard | 340/825.65 |
| 5,363,134 | A | 11/1994 | Barbehenn et al. | 347/49 |
| 5,394,375 | A * | 2/1995 | Iwashita | 365/230.06 |
| 5,610,635 | A * | 3/1997 | Murray et al. | 347/7 |
| 5,635,968 | A | 6/1997 | Bhaskar et al. | 347/59 |
| 5,940,095 | A | 8/1999 | Parish et al. | 347/19 |
| 6,022,094 | A | 2/2000 | Gibson et al. | 347/19 |
| 6,161,916 | A * | 12/2000 | Gibson et al. | 347/19 |
| 6,325,483 | B1 * | 12/2001 | Harbour et al. | 347/19 |
| 6,719,397 | B1 * | 4/2004 | Hu et al. | 347/19 |
| 6,837,564 | B2 * | 1/2005 | Akama et al. | 347/19 |
| 6,871,933 | B2 * | 3/2005 | Li | 347/19 |
| 7,019,866 | B1 * | 3/2006 | Beck et al. | 358/1.8 |
| 2003/0030687 | A1 * | 2/2003 | Hu et al. | 347/19 |
| 2003/0063297 | A1 * | 4/2003 | Dodd | 358/1.8 |
| 2004/0095409 | A1 * | 5/2004 | Hu et al. | 347/19 |

FOREIGN PATENT DOCUMENTS

| | | |
|---|---|---|
| EP | 0 765 762 | 4/1997 |
| EP | 0 765 762 A1 | 4/1997 |
| EP | 1 306 221 | 5/2003 |
| EP | 1 306 221 A2 | 5/2003 |

* cited by examiner

*Primary Examiner*—Stephen Meier
*Assistant Examiner*—Rene Garcia, Jr.
(74) *Attorney, Agent, or Firm*—Jiang Chyun IP Office

(57) ABSTRACT

An inkjet printer identification circuit is provided. It includes a plurality of control lines, a control circuit providing a control signal to the plurality of control lines, and an identification module including an identification unit. The identification unit includes at least a control input terminal, an output terminal and at least a data input terminal. The data input terminal is coupled to a memory unit. The control input terminal is coupled to one of the plurality of control lines. The identification unit is responsive to the control signal for determining and outputting a content stored in the memory unit via the output terminal. The control circuit identifies the status of the identification unit based on the received content stored in the memory unit.

21 Claims, 11 Drawing Sheets

202

202

306

INKJET PRINTER IDENTIFICATION CIRCUIT

CROSS REFERENCE TO RELATED APPLICATIONS

This application claims the priority benefit of Taiwan application serial no. 93101929, filed Jan. 29, 2004.

BACKGROUND OF INVENTION

1. Field of the Invention

This invention generally relates to an identification module for an inkjet print head, and more particularly to an identification module having combination logic circuit for an identification circuit of an inkjet printer.

2. Description of Related Art

FIG. 5 is a schematic diagram of a conventional identification circuit for an inkjet printer, disclosed by Hewlett-Packard Company in U.S. Pat. No. 5,363,134 entitled "Integrated circuit printhead for an ink jet printer including an integrated identification circuit". The identification module 526 provides the identification information of the inkjet print head 52 for the inkjet printer 50. The inkjet print head is disposed inside the inkjet printer 50. The inkjet printer 50 includes a controller 502 for controlling the operation of the inkjet 50, and a head drive circuit 504 for driving the inkjet print head 52. The inkjet printer 50 further includes three buses 506A–506C for example coupled between the controller 502 and the head drive circuit 504 for transmitting the digital control signals from the controller 502 to the head drive circuit 504, and for the head drive circuit 504 to output the corresponding analog voltage pulse to the circuits of the inkjet print head 52. The inkjet print head 52 includes an array circuit 522 for heating the ink based on the output signal of the head drive circuit 504 to eject the ink out of the nozzle. The identification module 526 provides the identification information of the inkjet print head 52 for the inkjet printer 50. The temperature sensing circuit 524 provides the temperature-related and other information relevant to the inkjet print head for the inkjet printer 50. A plurality of row lines (or so-called address lines) 528A and column lines (not shown in FIG. 5) are disposed between the head drive circuit 504 and array circuit 522. The head drive circuit 504 selects and drives the devices of the array circuit 522 via these row lines 528A and column lines. The detailed operation will be described as follows.

FIGS. 6A and 6B show a diagram of the array circuit and a circuit of a resistor unit, respectively. The array circuit 522 includes a plurality of resistor units 69 arranged in a plurality of rows and columns for heating the ink to eject out the ink through the nozzle. A plurality of row lines (e.g., A0–A5) and column lines (e.g., power supply lines P0–P5) are connected to the array circuit 522 to selectively provide the energy for the resistor unit 69 so that the selected resistor unit 69 can generate heat to vaporize the ink and eject drops of ink out of nozzles. Each resistor unit 69 includes a resistor 63 and a transistor 64, wherein the transistor 64 is coupled to one of the address lines A0–A5 to control the current flowing through the resistor 63. When a positive voltage is supplied respectively to the row line and the column line connected to the resistor unit 69, the transistor will be turned on and the current will flow through the resistor 63. Hence, the resistor 63 will vaporize the ink and eject drops of ink out of nozzles.

FIG. 7 is a conventional identification module. The identification module 526 is coupled to a plurality of row lines (e.g., A1–A13) and includes a plurality programmable paths consisting of a plurality of fuses (e.g., F1–F13) and a plurality of transistors (e.g., Q1–Q13). Each programmable path includes a fuse series-connected to the gate of a corresponding transistor. Each programmable path provides one-bit identification code for the inkjet printer 50. The one-bit identification code is "1" or "0" depending on whether the fuse is blown or not. Hence, the combination of the one-bit identification codes can provide different identification information for the inkjet printer 50.

In brief, the conventional identification circuit requires a row line for one bit identification code. Further, only one row line can be at logic high at a time. Therefore, to provide more identification codes, the cost of the identification circuit is higher and the size of the identification circuit becomes larger.

SUMMARY OF INVENTION

The present invention is directed to an identification circuit for an inkjet printer by using fewer control input terminals and control lines to read more identification codes. The control lines can use the existing address lines or power supply lines in the print head for reading the input signals of the identification codes.

The present invention is directed to an identification method for an inkjet printer, which is based on the combination or ways of arrangement of the logic levels of the control signal to read one of the memory units.

One or part or all of these and other features and advantages of the present invention will become readily apparent to those skilled in this art from the following description wherein there is shown and described a preferred embodiment of this invention, simply by way of illustration of one of the modes best suited to carry out the invention. As it will be realized, the invention is capable of different embodiments, and its several details are capable of modifications in various, obvious aspects all without departing from the invention. Accordingly, the drawings and descriptions will be regarded as illustrative in nature and not as restrictive.

According to an embodiment of the present invention, an inkjet printer identification circuit, for providing a content (or information) stored in an inkjet print head for an inkjet printer is provided. The inkjet print head is disposed inside the inkjet printer. The identification circuit comprises a plurality of control lines; a control circuit, for providing a control signal to the plurality of control lines; and an identification module including an identification unit, wherein the identification unit includes at least a control input terminal, an output terminal and at least a data input terminal. The data input terminal is coupled to a memory unit, and the control input terminal is coupled to one of the plurality of control lines. The identification unit is responsive to the control signal for determining and outputting a content stored in the memory unit via the output terminal.

In an embodiment of the present invention, the memory unit includes a fuse or a low-power (less than 0.3 W) resistor.

In an embodiment of the present invention, the identification unit includes a NAND gate. The NAND gate includes a plurality of NAND gate input terminals and a NAND gate output terminal, wherein one of the plurality of NAND gate input terminals is coupled to the data input terminal, one of the other of the plurality of NAND gate input terminals is coupled to the control input terminal, the NAND gate output terminal is an output terminal of the identification unit.

In an embodiment of the present invention, when the identification module includes a plurality of identification units, each of the plurality of identification units includes at least a control input terminal, an output terminal and a plurality of data input terminals, wherein the plurality of data input terminal is coupled to a corresponding one of a plurality of memory units respectively, and the control input terminal is coupled to a corresponding one of the plurality of control lines respectively. The identification unit is responsive to the control signal received from the plurality of control signals for determining and outputting a content stored in at least one of the plurality of memory units via the output terminal. In an embodiment of the present invention, each of the identification units comprises a plurality of AND gates and a NOR gate. Each of the AND gates includes a plurality of AND gate input terminals and a AND gate output terminal. One of the AND gate input terminals is coupled to one of the data input terminals, and the other AND gate input terminals are coupled to the control input terminal. The NOR gate includes a plurality NOR gate input terminals and a NOR gate output terminal. Each of the AND gate output terminals is connected to one of the NOR gate input terminals, and the NOR gate output terminal is the output terminal of the identification unit.

In an embodiment of the present invention, the control line is a power supply line or an address line.

The present invention is also directed to an inkjet print head identification module for an inkjet printer, for providing a content stored in an inkjet print head for an inkjet printer. The inkjet print head disposed inside the inkjet printer. The identification module comprises an identification unit comprising at least a control input terminal, an output terminal and at least a data input terminal, wherein the data input terminal is coupled to a memory unit, and the control input terminal is responsive to the control signal from the inkjet printer for determining and outputting a content stored in the memory unit via the output terminal.

The present invention is also directed to an inkjet printer identification method comprising using at least one control signal to read content stored in at least a memory unit, wherein the method is based on an arrangement of a signal level of the control signal for determining and reading the memory unit via an identification unit.

In an embodiment of the present invention, the reading of the memory unit includes reading the content stored in the memory unit via an address line or a power supply line.

The present invention is also directed to an inkjet printer identification method comprising using a control signal to read a content stored in a plurality of memory units, wherein the method is based on an arrangement of a signal level of the control signal for determining and reading one of the plurality of memory units.

In an embodiment of the present invention, the reading of one of the plurality of memory units includes reading the content stored in one of the plurality of memory units via one of a plurality of power supply lines or address lines.

The present invention utilizes the combination logic in the identification module so that it can use fewer control terminals and control lines to read more identification codes. The control lines can use the existing address lines or power supply lines in the print head for reading the input signals of the identification codes.

The above is a brief description of some deficiencies in the prior art and advantages of the present invention. Other features, advantages and embodiments of the invention will be apparent to those skilled in the art from the following description, accompanying drawings and appended claims.

DETAILED DESCRIPTION

Figure 1:
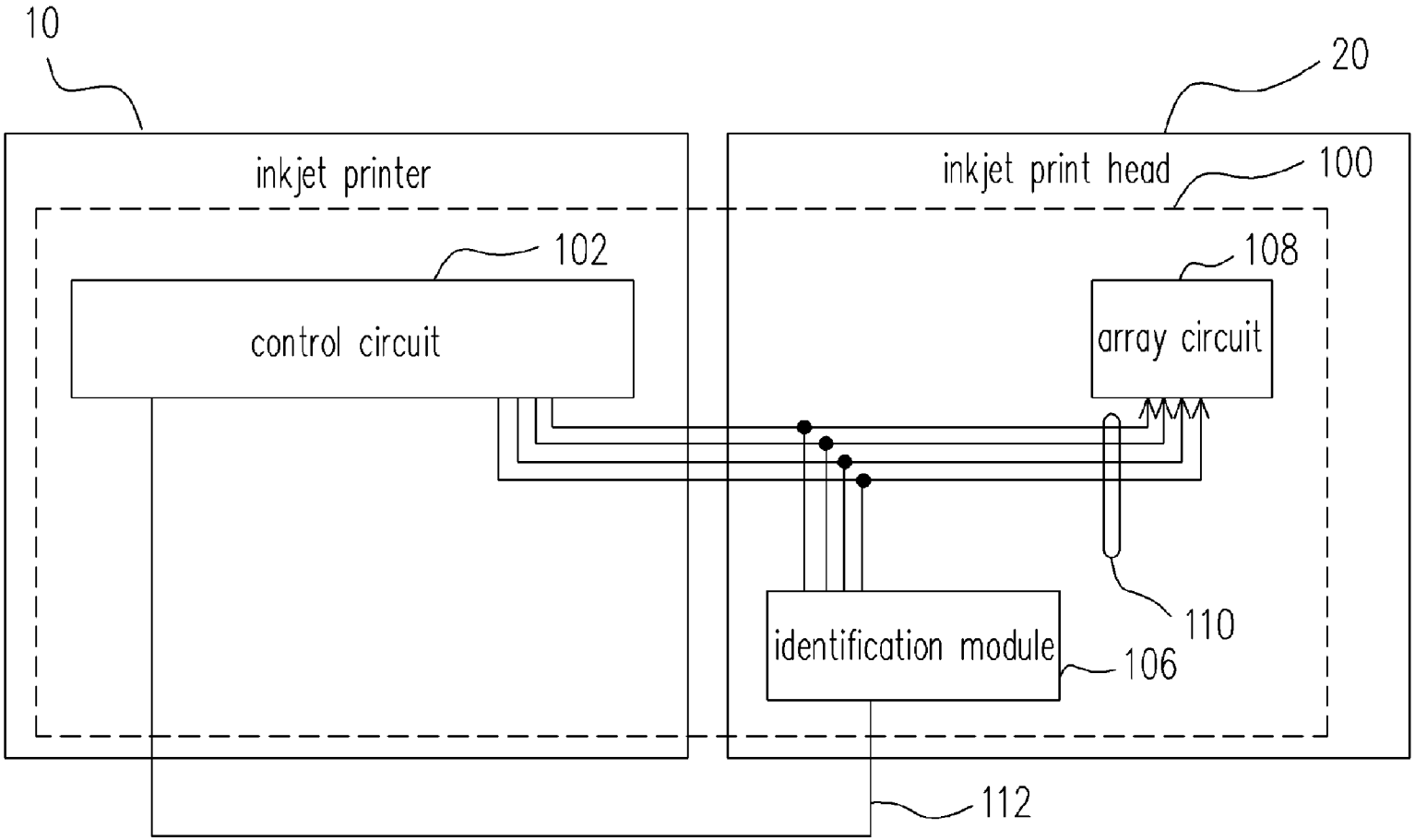
FIG. 1 is a schematic diagram of an inkjet printer in accordance with an embodiment of the present invention.

FIG. 1 is a schematic diagram of an inkjet printer in accordance with an embodiment of the present invention. The inkjet printer 10 includes a control circuit 102 for controlling the operation of the inkjet printer 10. The inkjet print head 20 includes a plurality of control lines 110 and an identification module 106. The identification module 106 is coupled to the control lines 110. The inkjet printer identification circuit 100 is coupled to an inkjet printer 10 and an inkjet print head 20. The inkjet printer identification circuit 100 provides the content stored in the inkjet print head 20 for the inkjet printer 10. The inkjet printer identification circuit 100 includes the control circuit 102, a plurality of control lines 110 and the identification module 106.

In an embodiment of the present invention, the content stored in the inkjet print head 20 can be, but not limited to, the ink cartridge product number, the number of inkjet nozzles, the volume of the ink, the manufactured date, the status of an ink cartridge or the type of the ink.

In this embodiment, the control circuit 102 provides the control signal to these control lines 110. The control lines 110 can be, but not limited to, the power supply lines or the address lines.

In an embodiment of the present invention, the identification module 106 is coupled to the control circuit 102 via the signal transmission line 112 and sends the content in the inkjet print head 20 to the inkjet printer 10.

In this embodiment, the control lines 110, for example, are coupled to the array circuit 108. In a practical circuit design, the control lines 110 can be coupled to the other external circuits.

Figure 2A:
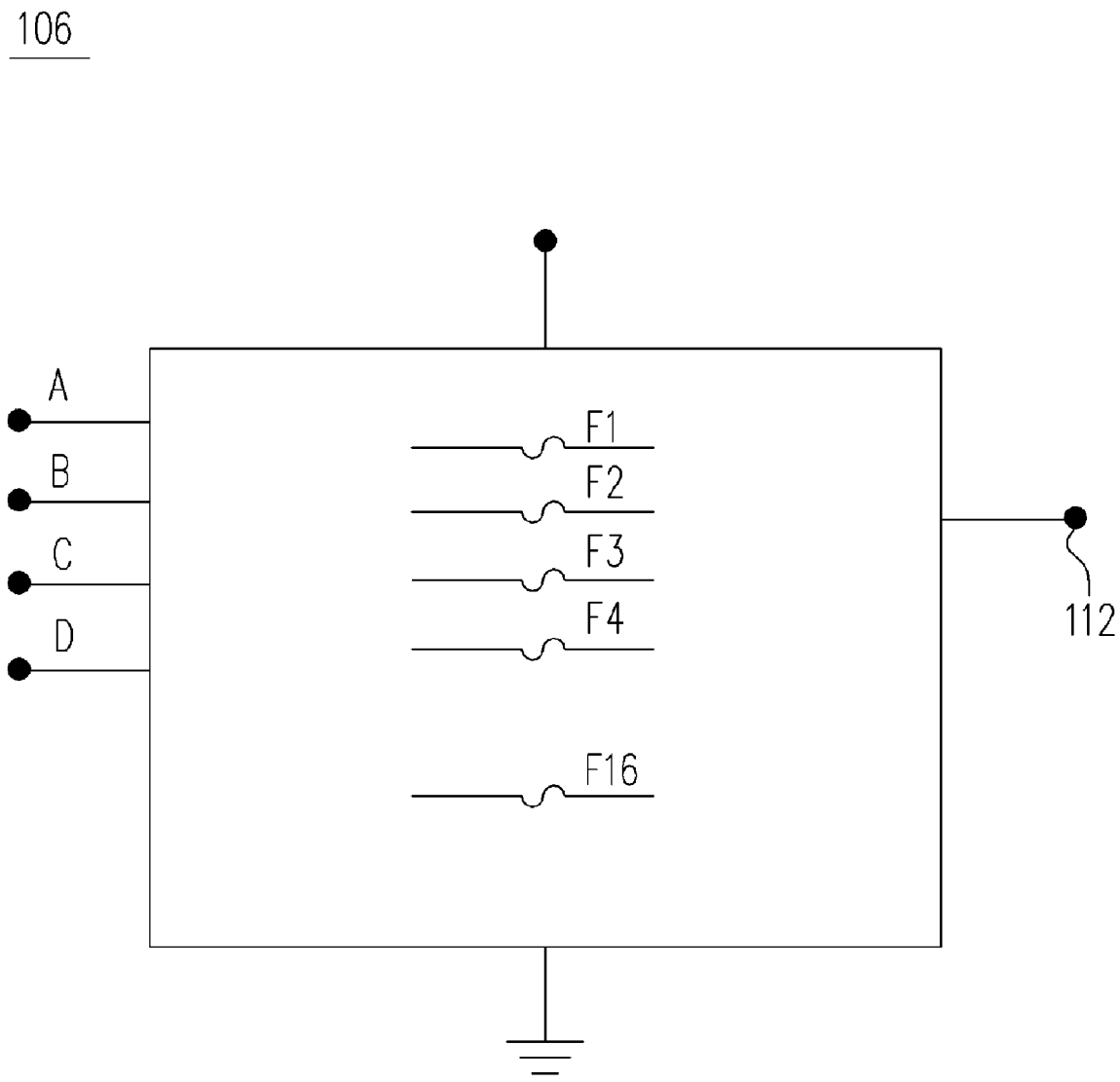
FIG. 2A is a schematic diagram of an identification module of an identification circuit of an inkjet printer in accordance with an embodiment of the present invention.

FIG. 2A is a schematic diagram of an identification module of an identification circuit of an inkjet printer in accordance with an embodiment of the present invention. In this embodiment, the identification module 106 can use, for example, four control input terminals A, B, C, and D to provide 2*2*2*2=16 different identification information via a combination logic. It should be noted that the identification module 106 is not limited to four control input terminals but can be more than or less than four control input terminals depending on how much content is required to be stored in the inkjet print head.

Figure 2B:
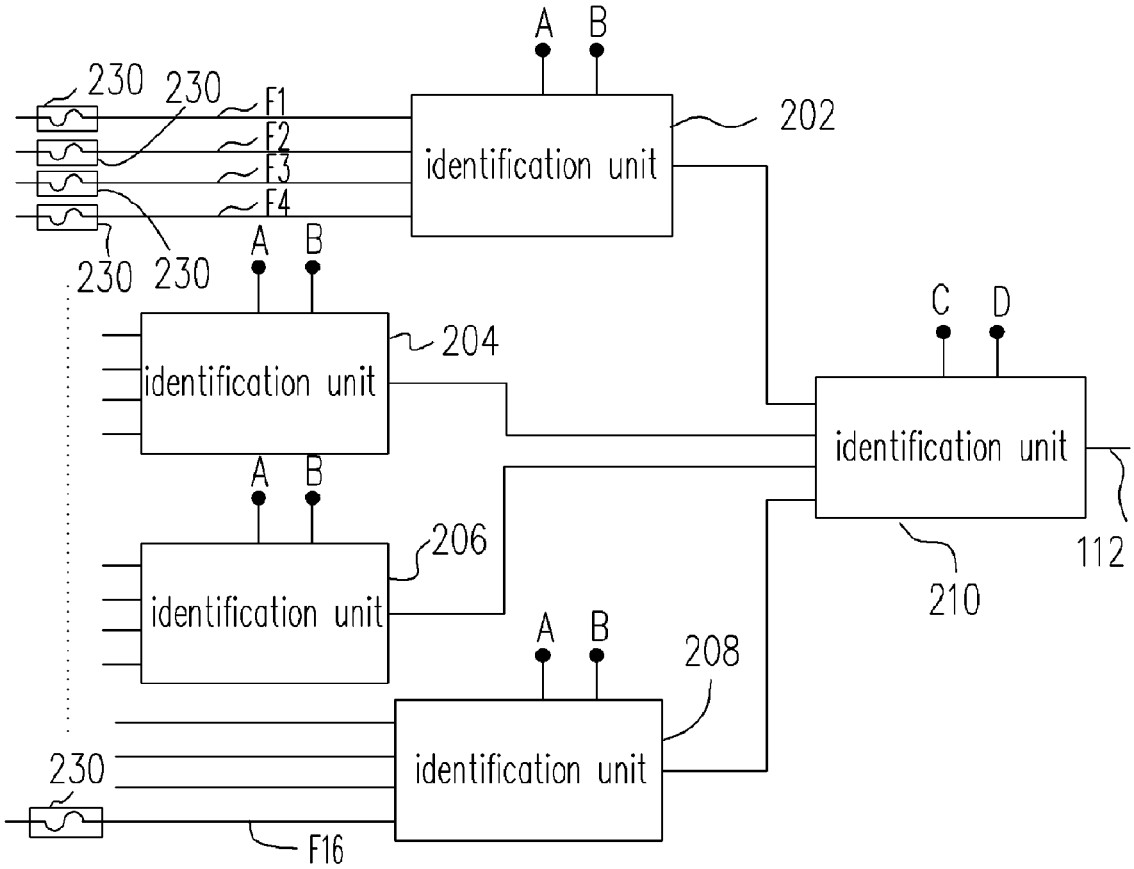
FIG. 2B is a block diagram of an identification module of an identification circuit of an inkjet printer in accordance with an embodiment of the present invention.

FIG. 2B is a block diagram of an identification module of an identification circuit of an inkjet printer in accordance with an embodiment of the present invention. The identification module 106 includes identification units 202, 204, 206, 208, and 210. The data input terminals (e.g., F1–F16) of the identification units 202–208 are coupled to a plurality of memory units 230 respectively. The identification units 202–208 receive the signals from the control input terminals A and B respectively. Further, the four input terminals of the identification unit 210 are coupled to the four output terminals of the identification units 202–208 respectively and receive the signals from the control input terminals C and D. It should be noted that the identification module 106 is not limited to only four identification units. Accordingly, one identification unit may also be used to achieve the purpose of the present invention. In such embodiment, the output terminal of the identification unit is coupled to the signal transmission line 112.

In an embodiment of the present invention, the memory unit 230 includes a fuse or a low-power resistor less than 0.3 W.

Figure 3A:
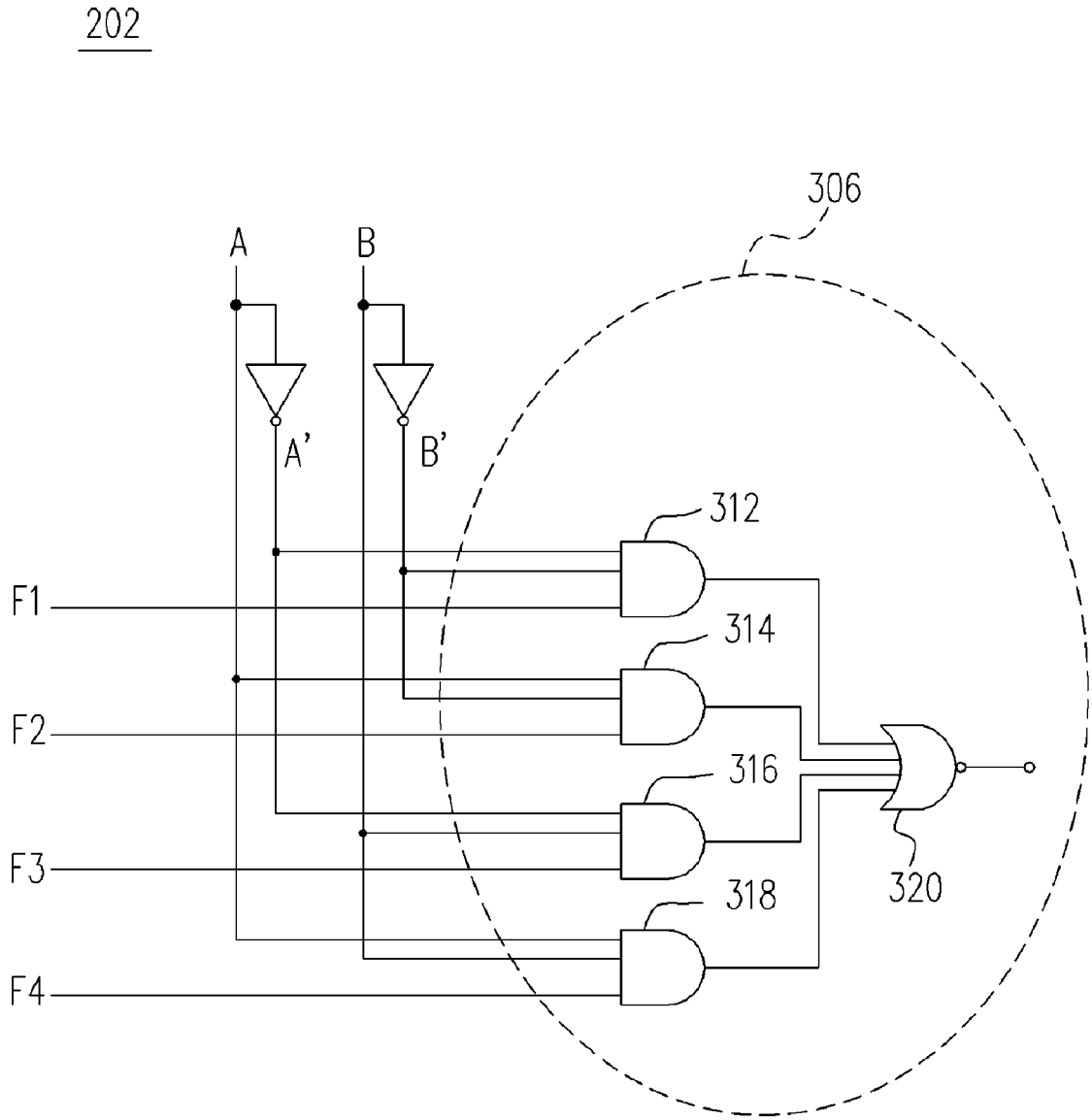
FIG. 3A is an identification unit with four data input terminals and two control input terminals in accordance with an embodiment of the present invention.

FIG. 3A is an identification unit with four data input terminals (F1~F4) and two control input terminals (A and B) in accordance with an embodiment of the present invention. In this embodiment, the identification unit 202 includes AND gates 312, 314, 316, and 318 and a NOR gate 320. The AND gate 312 receives the signals from the data input terminal F1, and A', B'. The AND gate 314 receives the signals from the data input terminal F2, and A, B'. The AND gate 316 receives the signals from the data input terminal F3, and A', B. The AND gate 318 receives the signals from the data input terminal F4, and A, B. The NOR gate 320 receives the output signals from the AND gates 312–318. In the identification unit 202, operation performed by each of the AND gates 312–318 results in logic 1 only when all inputs of corresponding AND gates are logic 1. The NOR gate 320 will output logic 0 when any one of the inputs of NOR gate 320 is logic 1; the NOR gate 320 will output logic 1 only when all inputs of the NOR gate 320 are logic 0. The output terminal of the NOR gate 320 is the output terminal of the identification unit 202.

Figure 3B:
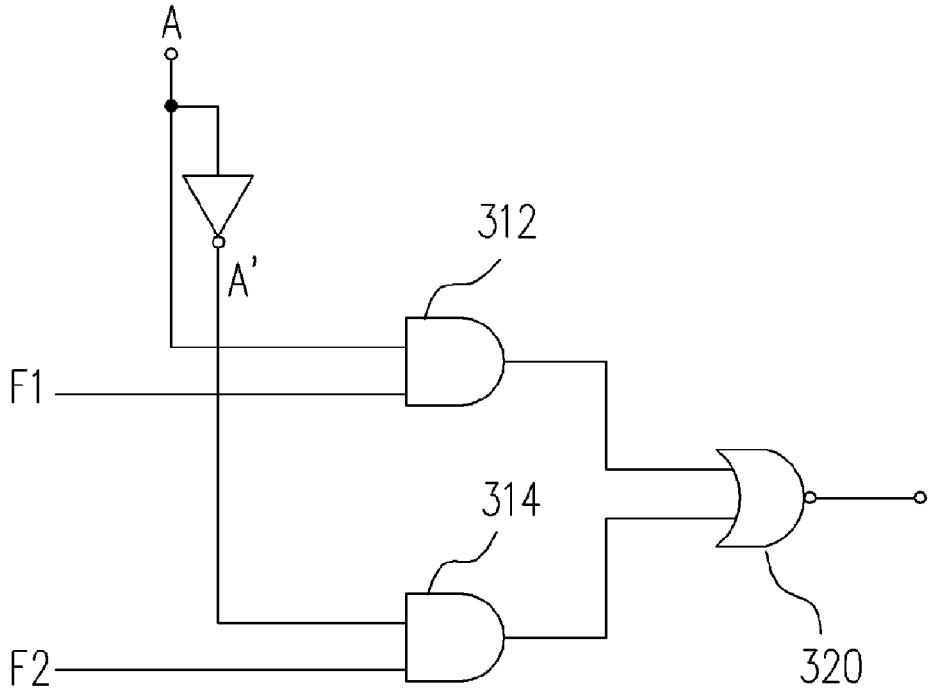
FIG. 3B is an identification unit with two data input terminals and one control input terminal in accordance with an embodiment of the present invention.

In this embodiment, the number of control input terminals is not limited to two (e.g., control input terminals A and B); it can be only single control input terminal (e.g., a control input terminal A). As shown in FIG. 3B, when the identification unit 202 has a control input terminal A and two data input terminals F1 and F2, the AND gate 312 receives the signals from F1 and A; the AND gate 314 receives the signals from F2 and A'. When both of the input terminals of each AND gate (312 and 314) are logic 1, the AND gates 312 and 314 will output logic 1. The NOR gate 320 will output logic 0 only when any one of the inputs of the NOR gate 320 is logic 1; the NOR gate 320 will output logic 1 only when all inputs of the NOR gate 320 are logic 0.

In other words, in the above embodiment, when there are n control input terminals, the identification circuit can read the content stored in 2*n* (F1–F2*n*) memory units.

Figure 3C:
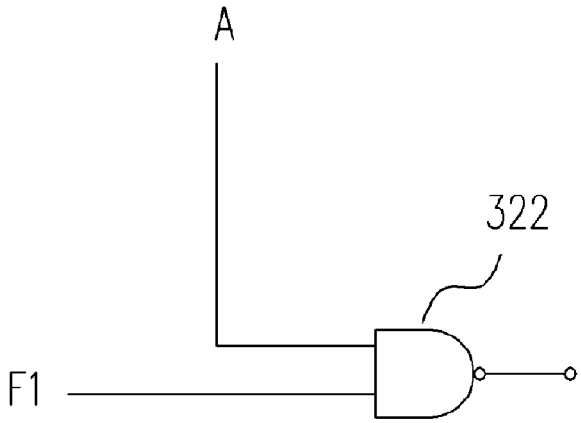
FIG. 3C is an identification unit with one data input terminal and one control input terminal in accordance with an embodiment of the present invention.

In the above embodiment, the identification unit 202 includes AND gates 312, 314, 316, and 318 and a NOR gate 320. In another embodiment, as shown in FIG. 3C, when there is only a control input terminal A and a data input terminal F1, the identification unit 202 can only include a NAND gate 322. In such embodiment, the NOR gate 320 in FIG. 3A is not required.

Figure 3D:
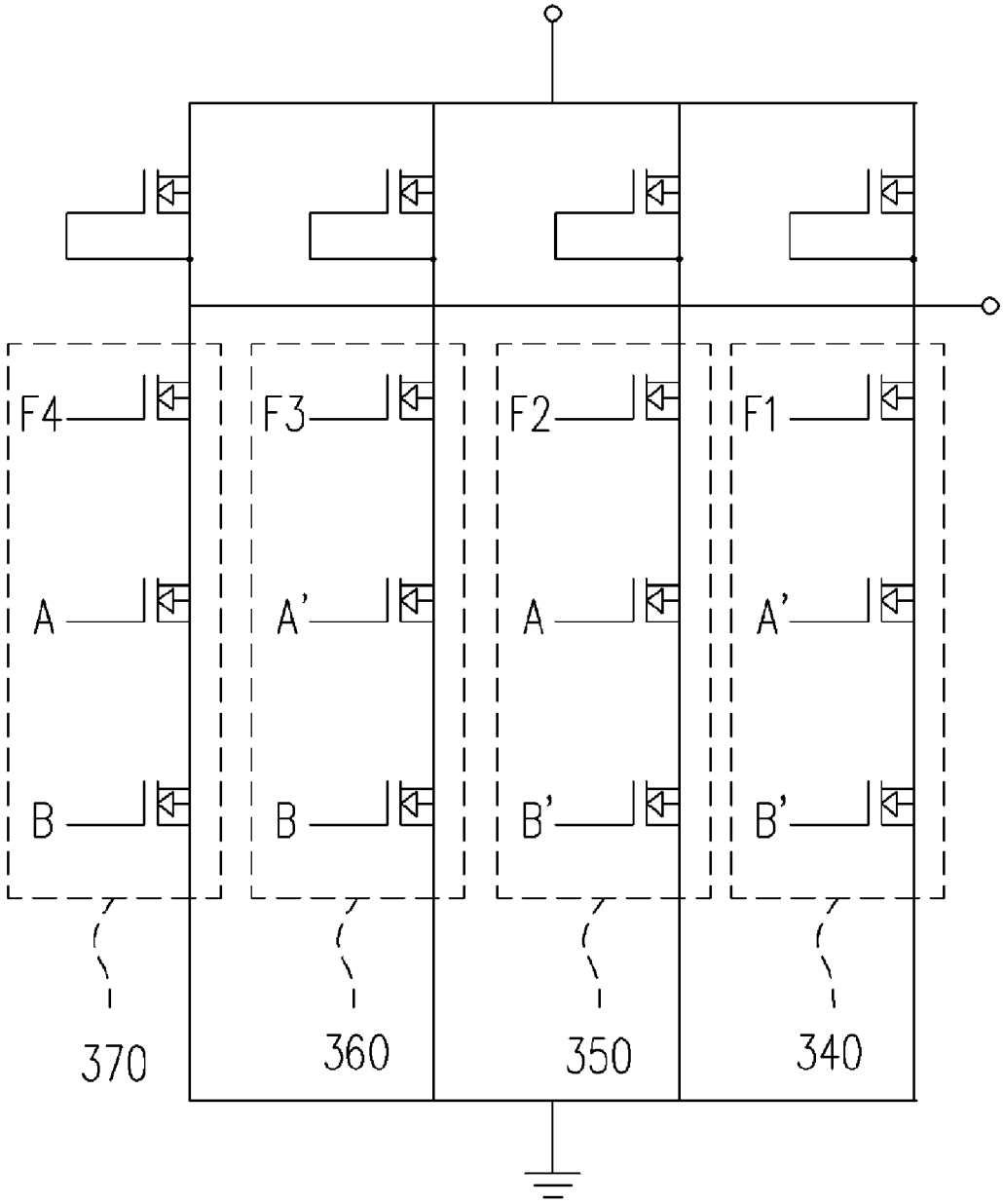
FIG. 3D is a NMOS circuit to implement the logic circuit enclosed in the dash circle 306 shown in FIG. 3A in accordance with an embodiment of the present invention.

FIG. 3D is a NMOS circuit to implement the logic circuit enclosed in the dash circle 306 shown in FIG. 3A. In this embodiment, the four AND gates of FIG. 3A are implemented by four sets of NMOS transistor units 340, 350, 360, and 370 respectively. Each NMOS transistor unit includes three NMOS transistors. For example, the NMOS transistor unit 340 includes 3 NMOS transistors to receive the input signals F1, A', and B'; the NMOS transistor unit 350 includes 3 NMOS transistors to receive the input signals F2, A, and B'; the NMOS transistor unit 360 includes 3 NMOS transistors to receive the input signals F3, A', and B; the NMOS transistor unit 370 includes 3 NMOS transistors to receive the input signals F4, A, and B. The operation is the same as the above identification unit 202.

Figure 3E:
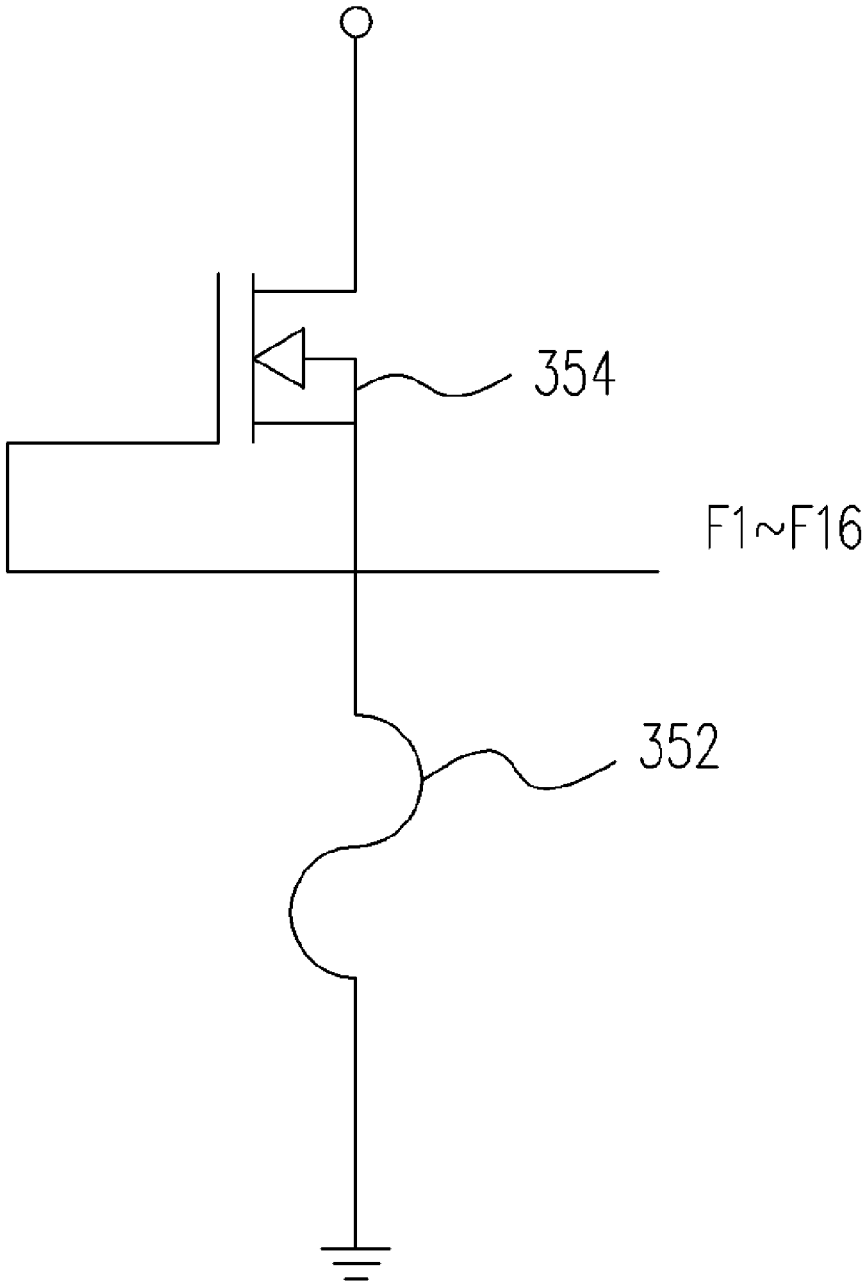
FIG. 3E is a fuse circuit in accordance with an embodiment of the present invention.

FIG. 3E is a fuse circuit in accordance with an embodiment of the present invention. In this embodiment, the memory unit 230 can be implemented by a fuse circuit as shown in FIG. 3E. The on/off of the fuse 352 is controlled by the NMOS transistor 354. The gate of the NMOS transistor 354 is coupled to one of the input signals F1–F16. When the gate of the NMOS transistor 354 receives logic 1, the NMOS transistor 354 will be turned on and the output of the memory unit 230 is logic 0; when the gate of the NMOS transistor 354 receives logic 0, the NMOS transistor 354 will be turned off and the output of the memory unit 230 is logic 1.

Figure 4:
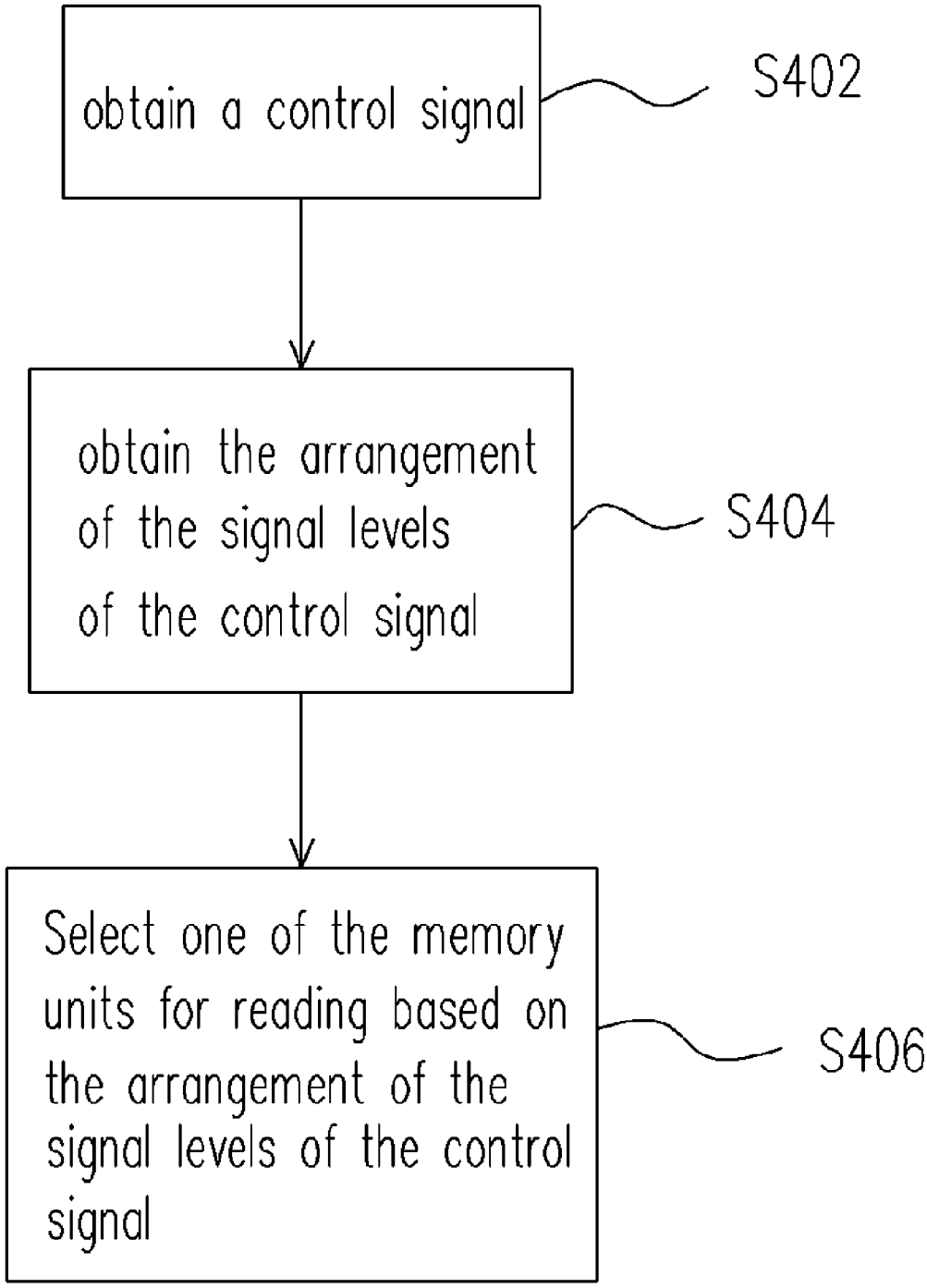
FIG. 4 is a flow chart of an identification method for an inkjet printer in accordance with an embodiment of the present invention.
Figure 5:
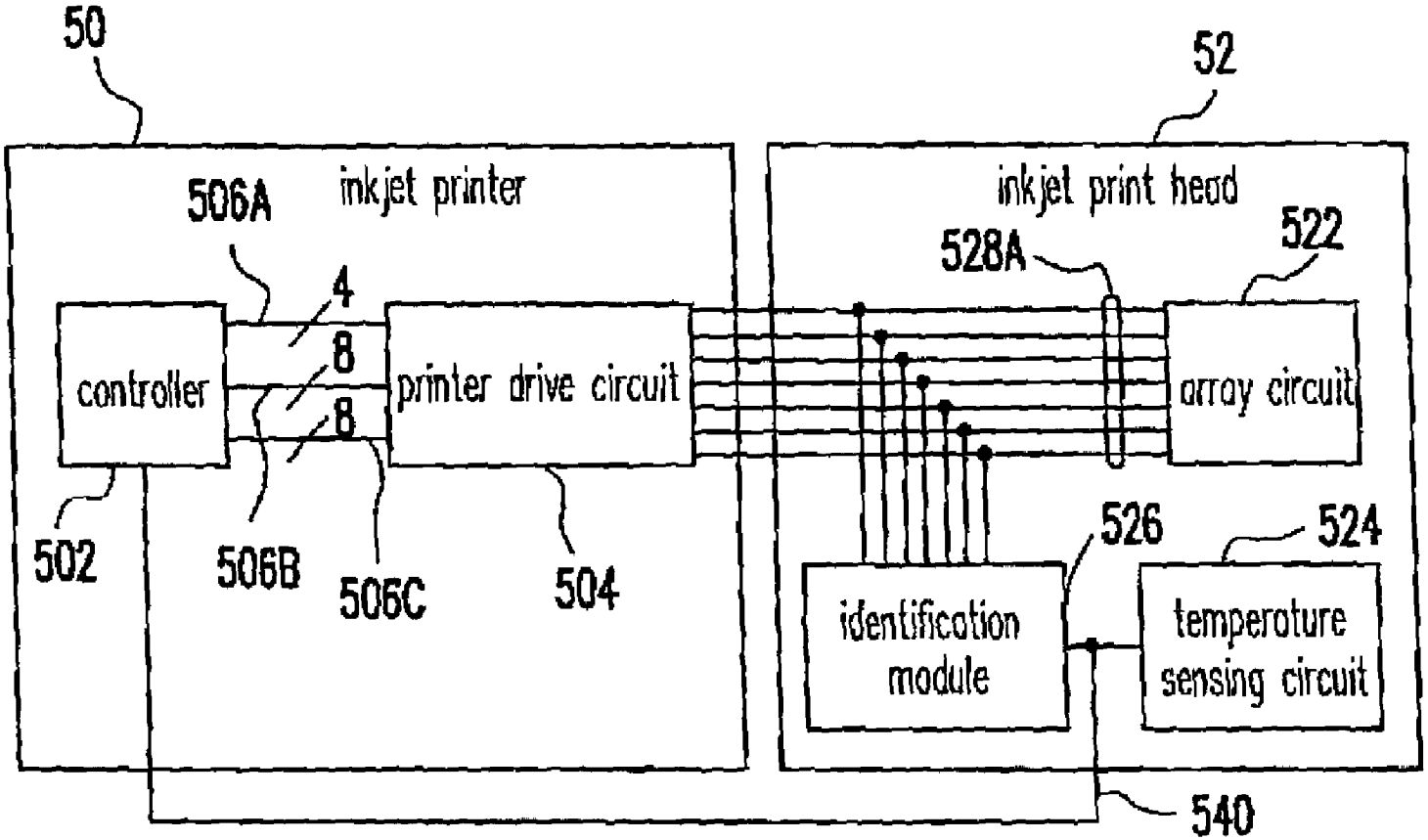
FIG. 5 (PRIOR ART)
FIG. 5 is a schematic diagram of a conventional identification circuit for an inkjet printer.
Figure 6A:
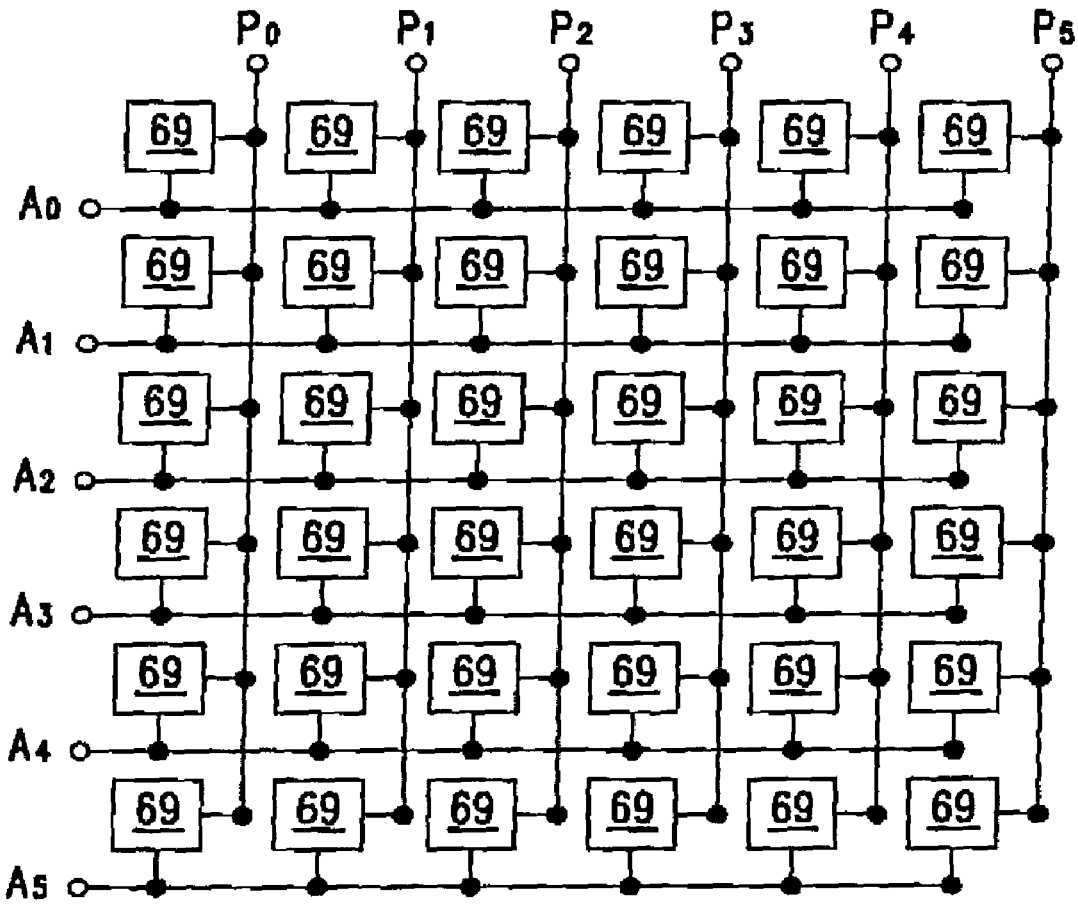
FIG. 6A(PRIOR ART)
FIG. 6A shows an array circuit of a conventional inkjet printer.
Figure 6B:
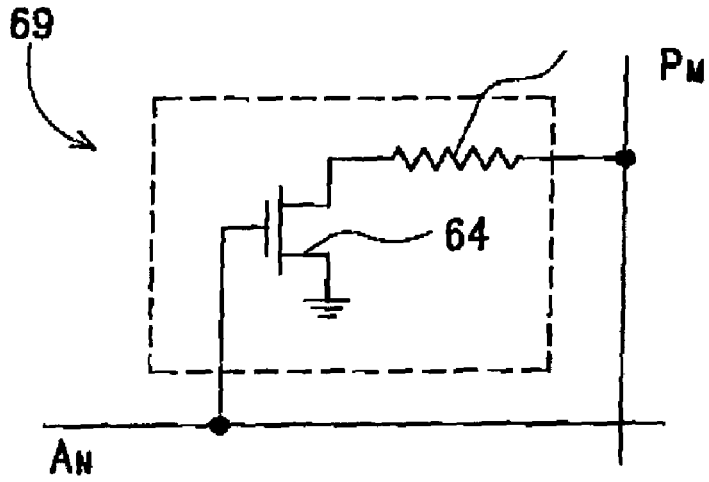
FIG. 6B(PRIOR ART)
FIG. 6B shows a circuit of a conventional resistor unit.
Figure 7:
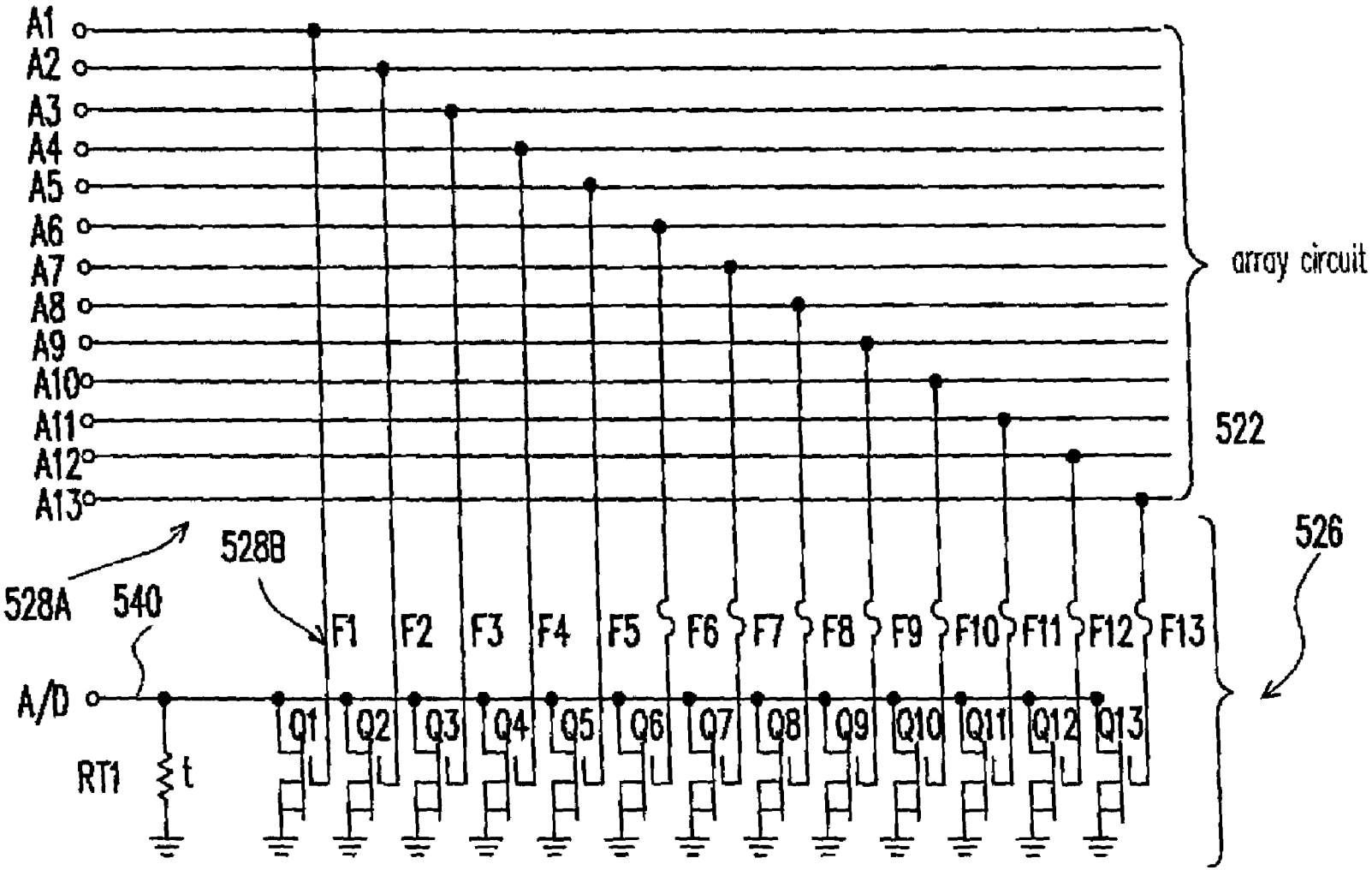
FIG. 7 (PRIOR ART)
FIG. 7 is a conventional identification module.

FIG. 4 is a flow chart of an identification method for an inkjet printer in accordance with an embodiment of the present invention. The first step is to obtain a control signal (S402). The next step is to analyze the control signal and obtain the arrangement of the signal levels of the control signal (S404). Then based on the arrangement of the signal levels of the control signal, one of the memory units will be selected for reading (S406). That is, the content stored in the selected memory unit will be read.

In an embodiment of the present invention, the identification method reads the content stored in the memory units via the identification unit through a plurality of address lines or power supply lines.

In light of the above, the inkjet printer identification circuit of the present invention utilizes the digital multiplexer (which can be a 2-to-1 multiplexer, 4-to-1 multiplexer, 8-to-1 multiplexer, etc. depending on the circuit design). Hence, it can use fewer control input terminals and control lines to read more identification codes. In addition, the control lines can use the existing address lines or power supply lines in the inkjet print head for reading the input signals of the identification codes. Further, because the present invention uses parallel input, the clock signal is not required to read the identification code.

The foregoing description of the preferred embodiment of the present invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

The invention claimed is:

1. An inkjet printer identification circuit, for providing a content stored in an inkjet print head for an inkier printer, said inkjet print head disposed inside said inkjet printer, comprising:

a plurality of control lines;

a control circuit, providing a control signal to said plurality of control lines; and an identification module, including a plurality of identification units, wherein each of said plurality of identification units comprises at least a control input terminal, an output terminal and a plurality of data input terminals, said plurality of data input terminals is coupled to a corresponding one of a plurality of memory units respectively, said control input terminal is coupled to corresponding one of said plurality of control lines, said identification units are responsive to said control signals received from said plurality of control lines for determining and outputting the content stored in at least one of said plurality of memory units via said output terminal.

2. The circuit of claim 1, wherein each of said memory units includes a fuse.

3. The circuit of claim 1, wherein each of said memory units includes a low-power resistor.

4. The circuit of claim 1, wherein each of said plurality of identification units comprises:

a plurality of AND gates, each of said plurality of AND gates including a plurality of AND gate input terminals and an AND gate output terminal, at least one of said plurality at AND gate input terminals being coupled to one of said plurality of data input terminals, the other said plurality of AND gate input terminals being coupled to said control input terminal; and a NOR gate, including a plurality of NOR gate input terminals and a NOR gate output terminal, each of said plurality of AND gate output terminals being coupled to one of said plurality of NOR gate input terminals, said NOR gate output terminal being said output terminal of said identification unit.

5. The circuit of claim 1, wherein said identification module is electrically coupled to said control circuit via a transmission line.

6. The circuit of claim 1, wherein said plurality of control lines is power supply lines.

7. The circuit of claim 1, wherein said plurality of control lines is address lines.

8. An inkjet printer identification module, for providing a content stored in an inkjet print head for an inkjet printer, said inkjet print head disposed inside said inkjet primer, comprising:

a plurality of identification units, wherein each of said plurality of identification units includes at least a control input terminal, an output terminal and a plurality of data input terminals, said plurality of data input terminal is coupled to a corresponding one of a plurality of memory unit respectively, said control input terminal is coupled to corresponding one of a plurality of control lines, said identification units are responsive to said control signals received from said plurality of control lines for determining and outputting a content stored in at least one of said plurality of memory units via said output terminal.

9. The inkjet printer identification module of claim 8, wherein each of said memory units includes a fuse.

10. The inkjet printer identification module of claim 8, wherein each of said memory units includes a low-power resistor.

11. The inkjet printer identification module of claim 8, wherein each of said plurality of identification units includes:

a plurality of AND gates, each of said plurality of AND gates including a plurality of AND gate input terminals and an AND gate output terminal, at least one of said plurality of AND gate input terminals being coupled to one of said plurality of data input terminals, the other said plurality of AND gate input terminals being coupled to said control input terminal; and a NOR gate, including a plurality of NOR gate input terminals and a NOR gate output terminal, each of said plurality of AND gate output terminals being coupled to one of said plurality of NOR gate input terminals, said NOR gate output terminal being said output terminal of said identification unit.

12. An inkjet printer identification method comprising:

using at least one control signal provided to an identification unit to read a content stored in at least a memory unit, wherein said memory unit is read via said identification unit based on an arrangement of a signal level of said control signal, wherein said control signal is logically operated with said content to obtain an output signal, wherein said identification unit includes at least a control input terminal, an output terminal and at least a data input terminal, said data input terminal is coupled to said memory unit, said control input terminal is coupled to one of said plurality of control lines, said identification unit is responsive to said control signal for determining and outputting a content stored in said memory unit via said output terminal, wherein said identification unit includes:

a plurality of AND gates, each of said plurality of AND gates including a plurality of AND gate input terminals and an AND gate output terminal, one of said plurality of AND gate input terminals being coupled to one of said plurality of data input terminals, the other said plurality of AND gate input terminals being coupled to said control input terminal; and a NOR gate, including a plurality of NOR gate input terminals and a NOR gate output terminal, each of said plurality of AND gate output terminals being coupled to one of said plurality of NOR gate input terminals, said NOR gate output terminal being said output terminal of said identification unit.

13. The method of claim 12, wherein the step of reading said memory unit includes reading said content stored in said memory unit via an address line.

14. The method of claim 12, wherein the step of reading said memory unit includes reading said content stored in said memory unit via a power supply line.

15. The method of claim 12, wherein said content at least includes one of an ink cartridge product number, a number of inkjet nozzle, a volume of ink, a manufacturing date, a status of an ink cartridge, a type of an ink.

16. The method of claim 12, wherein said memory unit includes a fuse.

17. The method of claim 12, wherein said memory unit includes a low-power resistor.

18. An inkjet printer identification circuit, for providing a content stored in an inkjet print head for an inkjet printer, said inkjet print head disposed inside said inkjet printer, comprising:

a plurality of control lines;

a control circuit, providing a control signal to said plurality of control lines; and an identification module, including an identification unit, said identification unit including at least a control input terminal, an output terminal and at least a data input terminal, said data input terminal being coupled to an output of a corresponding memory unit for receiving a binary content stored in said memory unit, said content of said memory unit being obtained by said identification unit via said data input terminal, said memory unit being externally and electrically connected to said identification unit, said control input terminal being coupled to one of said plurality of control lines, said identification unit responsive to said control signal for determining and outputting a determined content based on the binary content stored in said memory unit via said output terminal, wherein said determined content generated by said identification unit is outputted from said output terminal.

19. An inkjet printer identification module, for providing a content stored in an inkjet print head for an inkjet printer, said inkjet print head disposed inside said inkjet printer, comprising:

an identification unit, said identification unit including at least a control input terminal, an output terminal and at least a data input terminal, said data input terminal being coupled to an output of a corresponding memory unit for receiving a binary content stored in said memory unit, said content of said memory unit being obtained by said identification unit via said data input terminal, said memory unit being externally and electrically connected to said identification unit, said control input terminal receives a control signal from said inkjet printer, said identification unit responsive to said control signal for determining and outputting a determined content based on said binary content stored in said memory unit via said output terminal, wherein said determined content generated by said identification unit is outputted from said output terminal.

20. An inkjet printer identification method comprising:

using at least one control signal provided to an identification unit to read a content stored in at least a memory unit, wherein said content of said memory unit is read from an output of said memory unit by said identification unit via a data input terminal based on an arrangement of a signal level of said control signal, and said data input terminal is electrically coupled between said memory unit and said identification unit, wherein said control signal is logically operated with said content to obtain an output signal, and said output signal is outputted from an output terminal of said identification unit.

21. An inkjet printer identification method characterized in using a control signal provided to an identification unit to read a content stored in one of a plurality of memory units by said identification unit, wherein a content of one of said plurality of memory units is read from an output of said one of said plurality of memory units and inputted into said identification unit via a data input terminal based on an arrangement of signal level of said control signal, and said data input terminal is electrically coupled between said one of said plurality of memory units and said identification unit, wherein said control signal is logically operated with said content to obtain an output signal, and said output signal is outputted from an output terminal of said identification unit.

* * * * *